United States Patent [19]

Sprung

[11] 4,118,904

[45] Oct. 10, 1978

[54] BUILDING STRUCTURE

[76] Inventor: Philip D. Sprung, 1001-10th Ave., SW., Calgary, Alberta, Canada

[21] Appl. No.: 810,901

[22] Filed: Jun. 28, 1977

[51] Int. Cl.[2] ..... E04B 1/32

[52] U.S. Cl. ..... 52/63; 52/86; 135/1 R

[58] Field of Search ..... 52/63, 86, 745; 135/1 R, 4 R

[56] References Cited

U.S. PATENT DOCUMENTS

| | | | |
|---|---|---|---|
| 3,534,511 | 10/1970 | Cappella | 52/63 |
| 3,780,477 | 12/1973 | Sprung | 52/63 X |
| 3,791,076 | 2/1974 | Gahler | 52/63 |
| 3,811,454 | 5/1974 | Huddle | 52/63 |
| 3,953,955 | 5/1976 | Huddle | 52/63 |

FOREIGN PATENT DOCUMENTS

| | | | |
|---|---|---|---|
| 654,498 | 12/1962 | Canada | 52/86 |
| 2,302,500 | 7/1973 | Fed. Rep. of Germany | 52/63 |

*Primary Examiner*—J. Karl Bell
*Attorney, Agent, or Firm*—W. Irwin Haskett

[57] ABSTRACT

A building structure employing an easily erected and dismantled frame with a stressed membrane cover wherein the framework comprises a plurality of transversely disposed arch-like members spaced longitudinally of the building with a strip of fabric stretched between each adjacent pair of arches, each of said frame members being of an extruded aluminum alloy I beam having a web with an exterior crosshead and an interior crosshead. The I beam's exterior crosshead has a fabric capturing device interacting therewith to secure the edge of the fabric strip against escape and provide a weatherproof joint between the fabric and the beam. Extendable spreader beams are mounted on the upper side of the interior crosshead, they and any appurtenances other than the fabric capturing device already mentioned connected to or slung from the arch frame beams being positioned below the fabric membrane where they are protected from the weather and readily accessible from within the structure. To facilitate the handling, transport, erection and dismantling of the structure, the arches consist of a number of disconnectable small size lightweight components and all the separate parts of the frame are connected by bolts.

17 Claims, 8 Drawing Figures

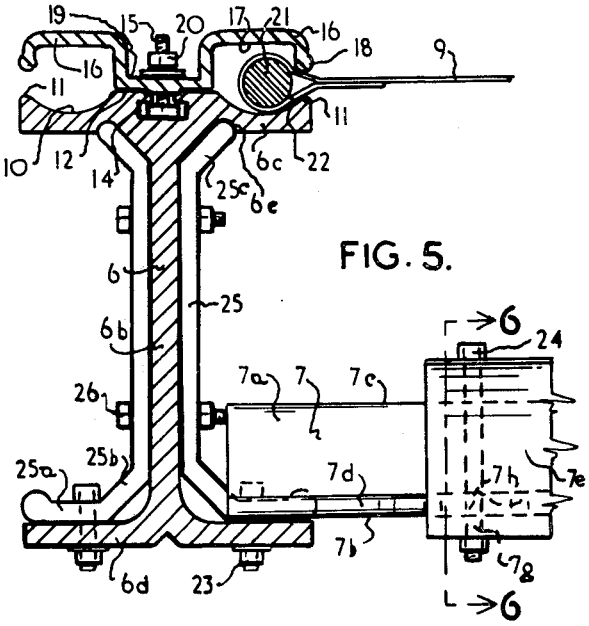
FIG. 5.
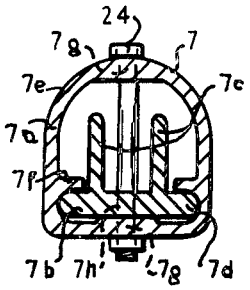
FIG. 6.
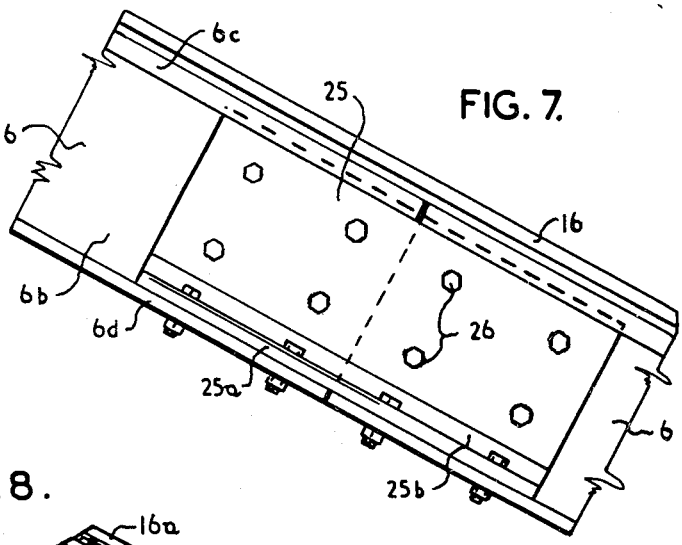
FIG. 7.
FIG. 8.
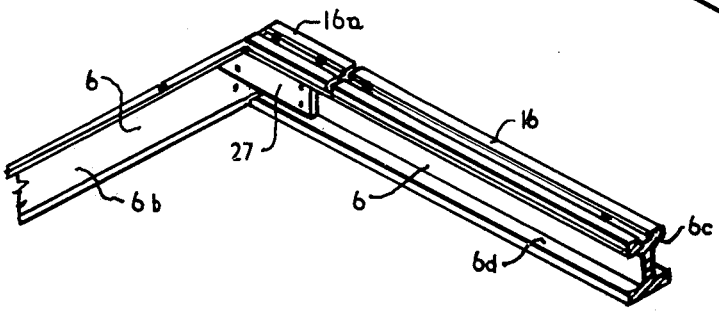

BUILDING STRUCTURE

A building structure employing an easily erected and dismantled frame with a stressed membrane cover wherein the framework comprises a plurality of transversely disposed arch-like members spaced longitudinally of the building with a strip of fabric stretched between each adjacent pair of arches, each of said frame members being of an extruded aluminum alloy I beam having a web with an exterior crosshead and an interior crosshead. The I beam's exterior crosshead has a fabric capturing device interacting therewith to secure the edge of the fabric strip against escape and provide a weatherproof joint between the fabric and the beam. Extendable spreader bars are mounted on the upper side of the interior crosshead, they and any appurtenances other than the fabric capturing device already mentioned connected to or slung from the arch frame beams being positioned below the fabric membrane where they are protected from the weather and readily accessible from within the structure. To facilitate the handling, transport, erection and dismantling of the structure, the arches consist of a number of disconnectable small size lightweight components and all the separate parts of the frame are connected by bolts.

This invention relates to improvements in a Building Structure of the type consisting of a space enclosing membrane covered frame.

The broader acceptance of membrane covered structure and the accelerating demand for such low cost lightweight space enclosures has resulted in the need for improved components that were stronger, easily assembled and would permit of the erection of larger buildings.

The present invention is an improvement on my Demountable Building, Canadian Pat. No. 937,479, Nov. 27, 1973, and is supplementary to though independent of co-pending Application Ser. No. 810,900, entitled A Stressed Membrane Space Enclosure.

It is an object of this invention to provide a building structure with a frame assembly comprising strong small size lightweight components that may be easily transported quickly put together and erected and covered with a durable fabric skin.

A further object of the invention is to provide a structural frame designed to support a stressed fabric cover and permit optimal development of the strength of the frame-membrane composite through equialization and dispersal of stress concentrations, being distinguishable from other tent-like structures by the form of the separable main frame parts, through the manner and relative arrangement in which the membrane sections are secured to the frame parts and in the means for securing the frame parts in spread relation after the membrane sections have been tensioned.

A further object of the invention is the provision of a structural frame comprising a plurality of spaced arch members formed of I-beams with the exterior crossbar of the I constituting a part of the fabric retainer and the interior crossbar of the I supporting the extendable arch spreader bars.

A further object of the invention is the provision of I-beam arches composed of a number of separable components bolted together including shiftable foot plates, splice plates, extendable spreader bars and fabric capturing plates.

A still further object of the provision of an aesthetic building structure having a demountable frame assembly that supports a stressed fabric skin, wherein the fabric skin is applied in individual sections between adjacent pairs of frame members, being secured by an escape-proof and leak-proof joint designed to withstand high tensional and surface loads.

To the accomplishment of the foregoing and related objects the invention resides in the construction, combination and arrangement of parts as shall be hereinafter more fully described, illustrated in the accompanying drawings and pointed out in the appended claims.

In the drawings, wherein like numerals indicate like parts throughout the several views;

FIG. 5 is an enlarged section through an arch frame member of I-beam shape with associated elements connected therewith;

FIG. 6 is a transverse section of the extendable spreader bar, as taken on line 6—6 of FIG. 5;

FIG. 7 is a side elevation of an I beam splice; and,

FIG. 8 is an isometric view of an apex splice.

Figure 1:
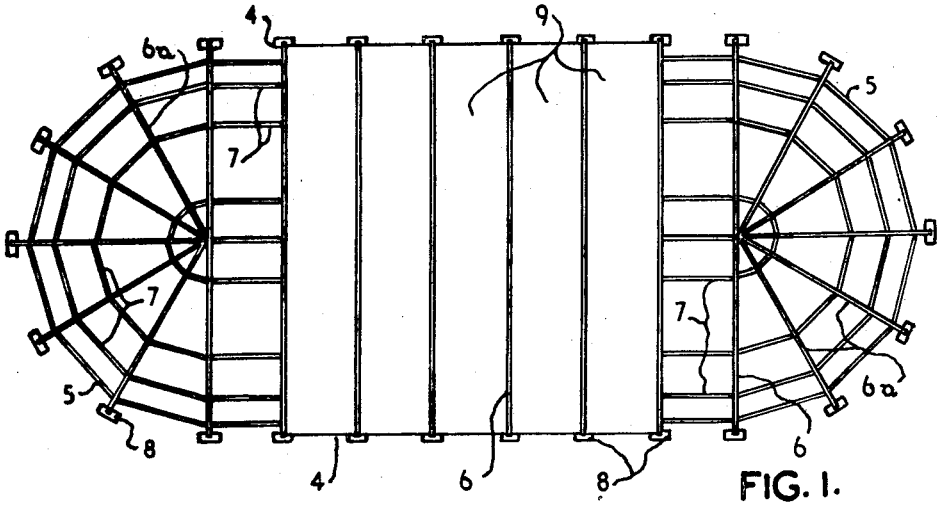
FIG. 1 is a plan view of one form of the invention with the fabric membrane only partially applied.
Figure 2:
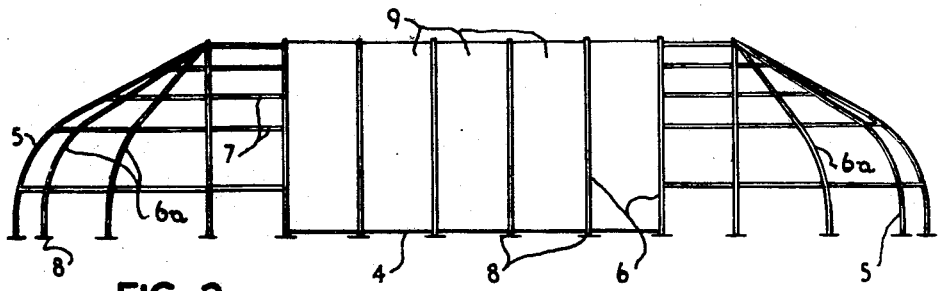
FIGS. 2 and 3 are side and end elevations thereof respectively.

Referring now to FIGS. 1 to 4 inclusive, it will be seen that this embodiment of the invention is in the form of an elongate open span structure with parallel sides 4 and fan-like semi-circular ends 5. Basically the frame consists of a plurality of arch frame members 6 arranged in upstanding spaced apart relation along the length of the building each such arch frame member being disposed transversely with respect to the longitudinal axis of the building. The arch frame members 6 are available in standard widths of 30, 40, 50, and 60 feet, with spans of 120 feet manufactured in the same basic geometry for custom orders. Arch members in the standard span width have a height of approximately one-half the width and are normally assembled in modular 10 foot sections while 15 foot modular sections are recommended for the extra wide spans. At each semi-circular end of the structure a fan of circumferentially spaced half arches *6a* is arranged in radial form to converge at the peak of the respective end regular arch member 6.

Extendable spreader bars 7 are installed horizontally between each pair of adjacent arch frame members 6 and/or *6a* at selected spaced apart levels. Each arch frame member foot is mounted on a horizontal, load-bearing pad 8 that at the time of the erection of the supporting frame is free to shift in any direction on the ground.

The membrane cover for this frame structure comprises a plurality of elongate fabric strips 9, each strip extending between a single pair of adjacent arch frame members 6 and/or *6a*.

To facilitate transport of the materials for this building structure and the on site assembly and erection thereof at remote and relatively inaccessible locations I provide the arch frame members 6 and the one-half arch frame members *6a* of a unique form including basically an I beam extrusion clearly shown in cross-section in FIG. 5. This I beam 6 has a stem or web *6b* with an exterior crosshead *6c* and an interior crosshead *6d*. The outer face of exterior crosshead *6c* has a pair of parallel spaced arcuate troughs 10 with their outer edges rounded as at 11 and a central rib 12 that stands higher than the outer rounded edges 11. A median groove 14 extends the length of the I beam being of inverted T shape with the stem of the T opening to the outer surface of the rib 12 for the purpose of carrying a plurality of bolts 15 inserted into the groove 14 from the end of the beam with their heads confined and held against rotation in the crossbar of the T shaped groove while the stems of the bolts project beyond the outer face of the exterior crosshead of the I beam.

Mounted on the outerface of the exterior crosshead 6*c* is a fabric capturing device 16 in the form of an elongate plate of the same width as crosshead 6*c* having a pair of spaced inverted channels 17 facing the respective troughs 10 and with outer rounded edges 18 confronting and spaced from the rounded trough edges 11 and provided with a median inverted ridge 19 between channels 17 that lies on the rib 12, said ridge descending to a depth below the rounded edges of said channels. Suitably spaced perforations in ridge 19 allow the stems of bolts 15 to pass therethrough and be engaged by washers and nuts 20 to firmly secure plate 16.

The elongate fabric strips 9 that may be of PVC coated polyester, nylon or the like with suitable reinforcement each extend between a single adjacent pair of arches 6 have their opposite longitudinal sides folded over a length of rope 21 and welded with a thermal fusion joint to provide a thickened or beaded edge 22. It is to be noted that the tubular-like housing constituted by each pair of confronting troughs 10 and channels 17 is more than ample to accommodate the beaded edge 22 of the fabric strip 9 and the constricted gap between the confronting rounded edges 11 and 16 is sufficient to loosely pass the double thickness of the folded over and welded edge of the fabric strip yet restricted to ensure captively of the thickened fabric edge. When the arches 6 are spread as by use of a suitable powerjack in the tensioning of the fabric, the beaded edge of the fabric 9 wedges tightly in a weatherproof grip self-centered between the confronting rounded edges of the gap.

The vertically spaced spreader bars 7 extending horizontally between each adjacent pair of arch frame member 6 and/or 6*a* at selected spaced apart levels comprise both male and female slidably related parts. As seen in FIGS. 5 and 6 a male part 7*a* having a wide flat base flange 7*b* and a pair of transversely spaced (longitudinally extending) ribs 7*c* rising therefrom is fastened on the upper side of the I beam's interior crosshead 6*d* by bolt 23 whose head lies between and is held against rotation by the spaced ribs 7*c*.

The ribs 7*c* lie inside the edges of the base flange 7*b* thus affording a projecting margin portion 7*d* on each such edge. Female part 7*e* is of substantially tubular cross-section with a rounded top and relatively flat bottom proportioned to easily receive the part 7*a* and provided with inwardly facing confronting inturned ridges 7*f* near the bottom on the opposite interior sides of the tube to form grooves to accommodate the margin portions 7*d* in sliding relation. Near each end the female tubular part 7*e* has in top and bottom a pair of vertically aligned bores 7*g* through which a bolt 24 projects while passing through a selected one of a spaced row of bores 7*h* in the base 7*b* of the male part.

A simple way to fasten the female part 7*e* to the arch frame member opposite that one to which the male part 7*a* is fastened is to secure a short projecting length of the male part extrusion in such opposite end of the female tube 7*e* and bolt its projecting end to the upper side of the interior crosshead 6*d* in the manner previously mentioned.

For ease in handling, transporting and erecting, the I beam arches are made up of several small relatively lightweight components including a pair of I beam parts that when assembled are connected in butt joint as seen in FIG. 7. Here a splice plate 25 is applied on each side of the stem 6*b* of the butted ends of the I beams and secured by bolts 26. It will be noted on reference especially to FIG. 6 that the plate 25 is of L shape having a flange 25*a* on its lower edge that extends out to the side of the interior crosshead 6*d* and furthermore that there is an inclined portion 25*b* between the body of the plate 25 and flange 25*a*. Also along its top edge the plate 25 has an inclined portion 25*c* that lies flat against the flared upper end of the stem 6*b* and the nose of which inclined portion 25*c* seats in a shallow arcuate groove 6*e* in the under side of exterior crosshead 6*c*. When the splice plate is being applied to a butted pair of I beams, the rounded nose of the upper inclined portion 25*c* is inserted in the aligned grooves 6*e* and as the plate is rotated on this center into position its lower end 25*a* clears the upper outer corner of the beam's lower crosshead 6*d* because of the cutaway inclined portion 25*b*. Additional bolts may also connect the plate's flange 25*a* to the crosshead 6*d*.

Figure 4:
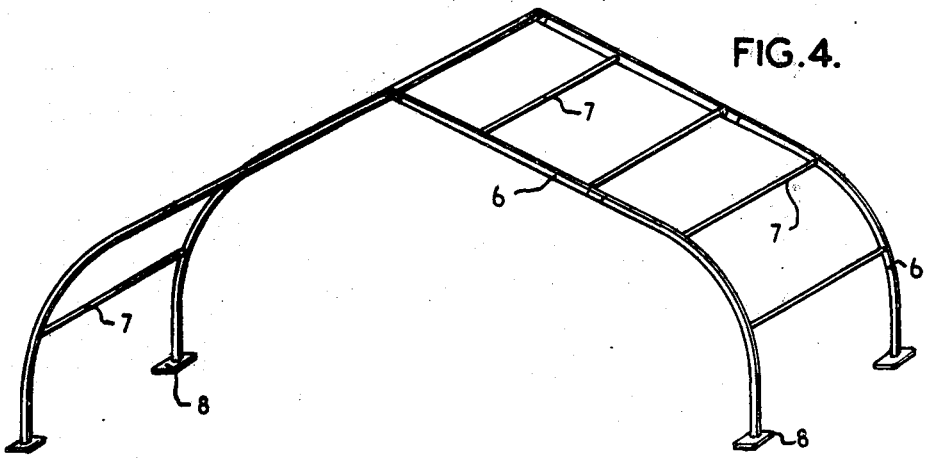
FIG. 4 is an enlarged isometric view of an assembled pair of arch frame members constituting a submodule or bay.
Figure 3:
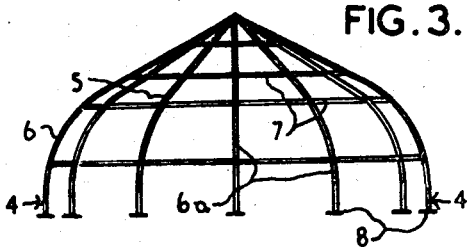

As can be best seen in FIG. 4 the cross-sectional shape of the structure is characterized by the arch frame members delineating a wide inverted V terminating at the base in gentle circular arcs tangential to the legs of the V and intersecting the ground at right angles. Where the arms of the V meet at the peak, an apex splice, see FIG. 8, is provided by a pair of flat splice plates 27 applied in overlapping relation to opposite sides of the abutting arch beams 6 and secured by transverse bolts. Also seen in FIG. 8 is a separate peak section of the fabric capturing plate 16 in the form of a unitary inverted V 16*a* defining the same obtuse angle as the underlying abutting arch beams 6. As it has been found expeditious to apply the fabric strips from the peak of the framework, this has been done by feeding the opposite beaded edges under the upper ends of plates 16 of the spaced pair of arches and drawing the lower end of the fabric strip to the ground. After this has been done the inverted V plate 16*a* is attached to the exterior crossheads 6*c* of the respective beams.

In addition to capturing the beaded edges of the fabric in a self-centering waterproof connection between the plates 16 and the exterior crossheads of the beams 6, the present construction and combination of the associated components is important in a stressed membrane space enclosure by keeping the fabric clear of the arch spreader jack and extendable spreader bars, and affording easy access from within the structure to such bars, splice plates and any other appurtenances connected to or slung from the framework.

The embodiment of the invention shown and described herein uses a simple I beam arch member which is suitable for most buildings but for larger structures a compound truss or girder is employed, constructed of a standard I beam severed mid-way of the stem and the exterior and interior crosshead portions separated a desired distance and the I beam parts connected by a lattice work of angle bars fastened at opposite ends to the spread apart positions of the severed stem. In this way the essential components of the arches are kept in normal relation with this exception that a second set of spacer bars is inserted between the beams at the outer side of the truss being appropriately mounted inside of the exterior crosshead.

From the foregoing description it will be seen that a clear span building structure is provided that can be rapidly assembled, erected and dismantled yet affords maximum floor and cubic air space at reasonable cost. It is to be understood that changes can be made thereto that do not depart from the spirit or scope of the appended claims.

What is claimed as new is:

1. A building structure comprising at least two spaced arch-like frame members provided with fabric capturing means for holding a fabric strip, a fabric strip having a thickened edge retained by said fabric capturing means, said fabric strip extending between spaced arch-like frame members, said arch-like frame members each including a beam structure having a web connected to and extending from a transverse exterior crosshead which extends across one end of said web to form lateral extensions on either side thereof, said exterior crosshead forming a unitary structure with said web and having an outer face remote from said web with an upstanding edge extending substantially parallel to said web adjacent each end of said outer face, said fabric capturing means including an elongate plate formed to provide a pair of upstanding edges spaced for a distance substantially equal to the distance between the upstanding edges on said exterior crosshead and mounting means to removably mount said elongate plate on the outer face of said exterior crosshead in spaced relationship thereto, said mounting means operating to secure the central portion of said elongate plate to the central portion of said crosshead with the upstanding edges of said elongate plate extending downwardly toward and in spaced relationship to the upstanding edges on said exterior crosshead to form therewith constricted gaps sufficient to loosely pass the fabric strip but restricted sufficiently to prevent passage of the thickened edge of said fabric strip, the space between the outer face of said crosshead and said elongate plate being ample to accommodate and permit movement of the thickened edge of said fabric strip.

2. The building structure of claim 1 wherein said mounting means includes an invented T shaped groove extending centrally of said exterior crosshead between and substantially parallel to the upstanding edges of said crosshead, the stem of said groove opening at the outer face of said exterior crosshead and bolt means having a head received and retained by said T shaped groove and a shank portion extending through the stem of said groove and projecting from said stem above the outer surface of said exterior crosshead, the central portion of said elongate plate being provided with openings to receive the extending shank portion of said bolt means.

3. The building structure of claim 1 wherein the outer face of said exterior crosshead includes a central section raised above the upstanding edges thereof to support said elongate plate.

4. The building structure of claim 1 wherein said elongate plate includes a central section raised above the upstanding edges thereof to engage the central section of the outer surface of said exterior crosshead.

5. The building structure according to claim 1 wherein the outer face of said exterior crosshead is formed to provide a pair of parallel spaced troughs, each trough having a rounded outer edge forming the upstanding edges of said exterior crosshead.

6. The building structure according to claim 1 wherein said elongate plate is formed to provide a pair of spaced inverted channels when mounted on said exterior crosshead, the outer wall of each such channel terminating in a rounded edge to form the upstanding edges of said elongate plate.

7. The building structure according to claim 5 wherein the outer face of said exterior crosshead includes a central section between said troughs raised above the upstanding edges thereof to support said elongated plate.

8. The building structure according to claim 6 wherein said elongate plate includes a central section between said channels raised above the upstanding edges thereof to engage the central section of the outer surface of said exterior crosshead.

9. The building structure according to claim 5 wherein said elongate plate is formed to provide a pair of spaced inverted channels when mounted on said exterior crosshead which extend above and substantially in line with the spaced troughs formed in said exterior crosshead, the outer wall of each such channel terminating in a rounded edge to form the upstanding edges of said elongate plate, the inverted channels facing the respective troughs of the exterior crosshead forming a spaced pair of housings to accomodate the thickened edges of said fabric strips.

10. The building structure of claim 2 wherein the outer face of said exterior crosshead includes a central section raised above the upstanding edges thereof to support said elongate plate, said central section including said central T shaped groove and said elongate plate includes a central section raised above the upstanding edges thereof to engage the central section of the outer surface of said exterior crosshead, the central section of said elongate plate including the openings to receive the extending shank portion of the bolt means.

11. The building structure of claim 10 wherein the outer face of said exterior crosshead is formed to provide a pair of parallel spaced troughs with one trough on each side of the central raised section of the outer face, each trough having a rounded outer edge forming the upstanding edges of said exterior crosshead and wherein said elongate plate is formed to provide a pair of spaced inverted channels when mounted on said exterior crosshead which extend above and substantially in line with the spaced troughs formed in said exterior crosshead, one channel being positioned on either side of the raised central section of said elongate plate with the outer wall of each such channel terminating in a rounded edge to form the upstanding edges of said elongate plate.

12. The building structure of claim 11 wherein each of said fabric strips has on opposed ends a thickened beaded edge formed by doubling back the margin of the fabric strip over a rope and securing the same by thermal fusion weld, the inverted channels of said elongate plate facing the respective troughs of the exterior crosshead to form a spaced pair of housings to loosely accomodate the beaded edges of said fabric strips while the upstanding rounded edges of the exterior crosshead confronting the upstanding rounded edges of the elongate plate form a constricted gap sufficient to loosely pass the doubled back margin of the respective fabric strip but constricted sufficiently to ensure the captivity of the beaded fabric edge in a waterproof grip against and between the confronting rounded edges of the gap.

13. The building structure of claim 1 wherein said beam structure includes a transverse interior crosshead unitary with said web which extends across the end of said web opposite to the end connected to said exterior crosshead to form an I shaped beam structure, said beam structure forming the arch-like frame members including a plurality of separable I beam units connected at butt joints by a pair of L-shaped splice plates secured on opposite sides of the connected I beam units, each such L-shaped splice plate having a stem portion for engaging the webs of the I beam units and a laterally extending flange at one end of the stem for engaging an inner surface of the interior crosshead of the I beam units, said flange being connected to the stem by an intermediate inclined section which is angled outwardly from said webs when the splice plate is in engagement therewith, each said I beam unit having a groove formed in an inner face of said exterior crosshead on either side of the web for the reception of the end of said stem portion opposite to said flange, the intermediate inclined section permitting the splice plate with the end of the stem portion in said groove to pivot into engagement with the web and seat the flange on the inner surface of said interior crosshead.

14. The building structure of claim 1 wherein said beam structure includes a transverse interior crosshead unitary with said web which extends across the end of said web opposite to the end connected to said exterior crosshead to form an I shaped beam structure, and spreader means are secured to adjacent spaced arch-like frame members to spread said frame members apart to tension fabric strips held by said fabric capturing means, said spreader means including extendable spreader bars having opposite ends secured to the interior crossheads of adjacent arch-like frame members, each such extendable spreader bar including slidably related elongate male and female parts, the male part having a wide flat base with a spaced pair of longitudinally extending ribs rising therefrom and spaced inwardly from the longitudinal peripheral edge sections of said base, and a row of spaced bores formed in the base between said ribs, said female part being of substantially tubular cross-section proportioned to receive said male part and including a flat wall to engage and seat the base of said male part and a pair of opposed-rib means formed on said female part in spaced relation to said flat wall to engage the longitudinal peripheral edge sections of said base to retain the base against said flat wall, the female part being further provided with base means registerable with one of the spaced bores in the male part to receive a fastening bolt connecting said male and female parts.

15. The building structure of claim 14 wherein said beam structure forming the arch-like frame members includes a plurality of separable I beam units connected at butt joints by a pair of L-shaped splice plates secured on opposite sides of the connected I beam units, each such L-shaped splice plate having a stem portion for engaging the webs of the I beam units and a laterally extending flange at one end of the stem for engaging an inner surface of the interior crosshead of the I beam units, said flange being connected to the stem by an intermediate inclined section which is angled outwardly from said webs when the splice plate is in engagement therewith, said I beam unit having a groove formed in an inner face of said exterior crosshead on either side of the web for the reception of the end of said stem portion opposite to said flange, the intermediate inclined section permitting the splice plate with the end of the stem portion in said groove to pivot into engagement with the web and seat the flange on the inner surface of said interior crosshead.

16. A building structure according to claim 12, wherein the elongate plate secured to the outer face of the exterior crosshead includes a separate peak section of wide inverted V form for attachment after the application of the fabric strips.

17. A building structure according to claim 1, wherei the arch-like frame members delineate a wide inverted V terminating at the bases in circular arcs tangential to the legs of the V and intersecting the ground at right angles and having where the arms of the V meet at the peak a pair of flat splice plates applied in overlapping relation to opposite side to abutting beam structures.

* * * * *